US005353673A

United States Patent [19]

Lynch

[11] Patent Number: 5,353,673

[45] Date of Patent: Oct. 11, 1994

[54] BRASS-WIND MUSICAL INSTRUMENT MOUTHPIECE WITH RADIALLY ASYMMETRIC LIP RESTRICTOR

[76] Inventor: John H. Lynch, 6020 Liberty Ave., Vermilion, Ohio 44089

[21] Appl. No.: 116,913

[22] Filed: Sep. 7, 1993

[51] Int. Cl.[5] ..... G10D 9/02

[52] U.S. Cl. ..... 84/398

[58] Field of Search ..... 84/383 R, 398

[56] References Cited

U.S. PATENT DOCUMENTS

| | | | |
|---|---|---|---|
| 1,513,950 | 11/1924 | Widmayer | 74/399 |
| 1,655,656 | 1/1928 | Morris | 84/398 |
| 1,691,669 | 11/1928 | Ostendorf | 84/399 |
| 1,852,749 | 4/1932 | Hiner | 84/399 |
| 2,018,738 | 10/1935 | Parduba | 84/398 |
| 2,104,388 | 1/1938 | Lunow | 84/398 |
| 2,232,608 | 2/1941 | Hulsaver | 84/398 |
| 2,265,756 | 12/1941 | Graber | 84/398 |
| 2,376,453 | 5/1945 | Ruettiger | 84/398 |
| 2,594,869 | 4/1952 | Caufman | 84/398 |
| 2,667,803 | 2/1954 | Jones | 84/398 |
| 3,339,444 | 9/1967 | Brooks | 84/399 |
| 3,370,500 | 2/1968 | Zwolak | 84/398 |
| 3,611,860 | 10/1971 | Tichenor | 84/398 |
| 3,728,929 | 4/1973 | Sanders | 84/398 |
| 3,807,271 | 4/1974 | Nipken | 84/399 |
| 4,098,164 | 7/1978 | Callicchio | 84/399 |
| 4,395,933 | 8/1983 | Shepley | 84/399 |

*Primary Examiner*—Michael L. Gellner
*Assistant Examiner*—Patrick J. Stanzione

[57] ABSTRACT

A mouthpiece for brass-wind musical instruments has at one end a shank (22) that is inserted into the brass-wind instrument, and at the opposite end an enlarged head containing a cavity called the cup, this cup having a rim surface (34) that is adapted to be pressed against the lips of the user. The shank (22) contains an air passageway (24) which extends to the cup for the purpose of conducting air and lip vibrations into the instrument. Incorporated into the cup, rim surface (34) or both is a lip restrictor (28) for limiting the amount that, the users bottom lip enters the mouthpiece. This lip restrictor (28) extends upper register and eases playing effort without affecting tone.

3 Claims, 1 Drawing Sheet

FIG. 1-PRIOR ART
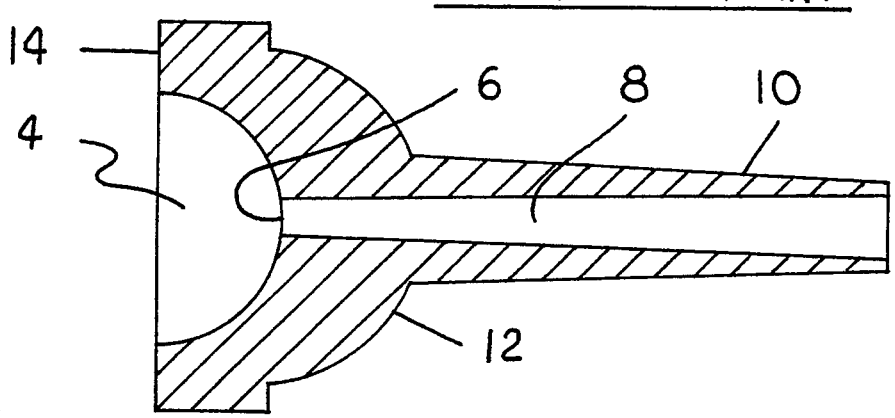
FIG. 2A
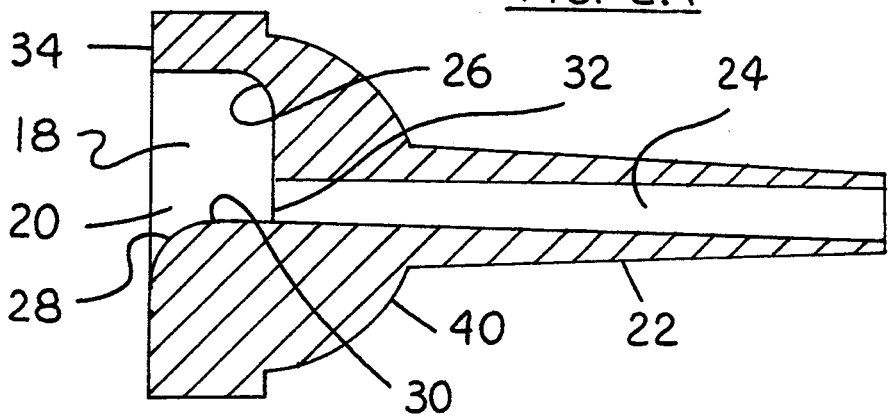
FIG. 2B
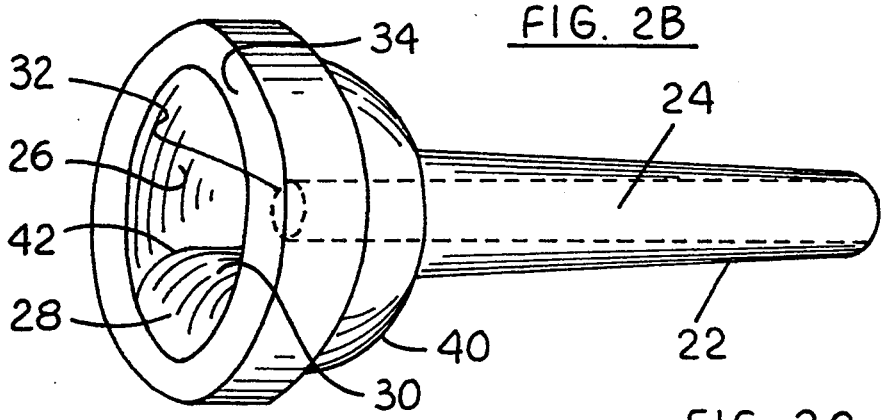
FIG. 2C
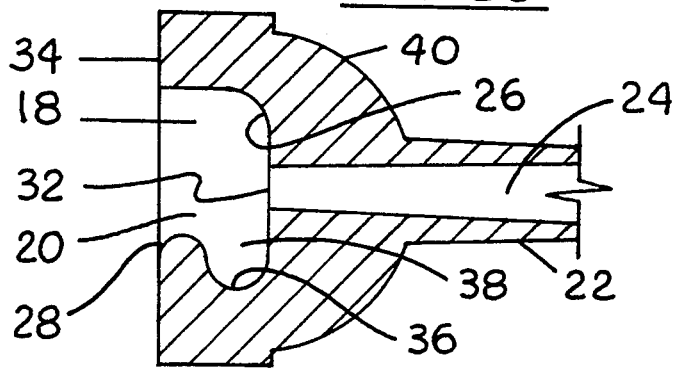

BRASS-WIND MUSICAL INSTRUMENT MOUTHPIECE WITH RADIALLY ASYMMETRIC LIP RESTRICTOR

FIELD OF THE INVENTION

This invention relates to mouthpieces for brass-wind musical instruments such as trumpets, cornets, trombones, and horns.

DESCRIPTION OF PRIOR ART

Brass-wind instrument mouthpieces are made, and have always been made, in the general configuration shown in axial cross-section in FIG. 1. The salient features of such a mouthpiece are a radially symmetric cup 4, a throat opening 6, a backbore 8, a shank 10, a cosmetic surface 12 and an annular rim surface 14. The shank is tapered to fit a brass-wind instrument, and the rim surface is adapted to be pressed against a player's lips. Air expelled through the player's lips through the mouthpiece cup and backbore causes lip vibrations which induce vibratory motion in the air contained in the instrument. This motion results in sound production. The performance characteristics of a mouthpiece are determined by the physical contours and dimensions of the rim surface, cup, throat opening, and backbore.

Several attempts have been made, over at least the past one hundred years, to improve the performance of brass-wind mouthpieces in various respects such as ease of playing, more desirable tone and easier high register. Although problems in these three areas are present with all brass instruments, they are especially acute for soprano instruments. Therefore, in the following discussions, the trumpet has been selected for detailed illustration.

Efforts to improve trumpet mouthpieces in these areas have been, to my knowledge, essentially trial and error approaches, wherein improvement is determined by soliciting the opinions of various musicians, arbitrarily accepted as expert performers. This approach to mouthpiece development, being fraught with entrenched lore and scientifically unsubstantiated rhetoric, has, however, been generally unproductive.

Some progress has been made from these empirical activities, but only a few generalizations have emerged which appear to hold true for mouthpieces having the features shown in FIG. 1. Two of these, which are generally accepted as, "rules-of-thumb" and which are in widespread use among mouthpiece manufacturers are:

(a) A mouthpiece having a shallow, low-volume cup enables higher notes to be played more easily but produces a shrill, metallic tone quality throughout the complete range of the instrument. Shallow-cup mouthpieces are, therefore, desirable for the former property and undesirable for the latter.

(b) A mouthpiece having a deep high-volume cup produces a more desirable tone but is difficult, if not impossible, to play in the higher register. Deep-cup mouthpieces are, therefore, desirable for the former property and undesirable for the latter. These rules have led to two distinct approaches to playing higher pitched brass-wind instruments, especially the trumpet.

The more common approach, adopted by most trumpet players, is to use a mouthpiece having a cup of intermediate depth as a compromise. But by so doing, these players adversely limit or impair, to varying degrees, their performance in the high register and their tone qualities. The other approach has been to use either a very deep-cup mouthpiece or a very shallow-cup mouthpiece depending on the type of performance indulged in by the particular performer, i.e. if all of his performances require extreme high-register playing, he will use a very shallow-cup mouthpiece and accept the harsh, brassy sound. But if all of his performances don't require extreme high-register playing, he will use a deep-cup mouthpiece in order to obtain a more sonorous and desirable sound. These have been and are, the traditional approaches to mouthpiece selection, and both leave much to be desired.

In the case of the trumpet player who chooses the compromise of medium-depth cup, clearly such a compromise produces a player of limited ability as an altissimo player and one whose tone quality is somewhat less than ideal. And for the player who biases his selection of mouthpiece cup depth either toward a very shallow or a very deep cup, similar limitations are seen in either high register capability or tone quality. These limitations are a problem, because a performer's lips must be acclimated to a change in mouthpieces. This acclimation requires on the order of days, and in some cases weeks. Therefore, it is not feasible to change mouthpieces from one cup design to another to suit the immediate demands of the music being played in an actual performance situation. Thus, presently available mouthpieces do not offer brass players an effective solution for either the high-playing difficulty or tone problems.

In addition to these problems, there are others that are fundamental to brass-wind instrument playing and to trumpet playing in particular that presently available mouthpieces have not solved. One of these additional problems is that even the shallowest available mouthpiece can only be played by most non-student players, many of whom are proficient players in other respects, up to a modestly high limit of about high C or lower. Another is the great physical effort that must be exerted at and around any player's particular high limit. This is a problem especially for trumpet players. The trumpet is arguably the most physically difficult of the brass-wind instruments to play, because it is the soprano brass-instrument. Players of this instrument are expected to be able to perform in the altissimo range, sometimes as high as C above high C. Only a tiny fraction of all trumpet players has ever achieved this level of expertise. And few, if any of these people are in agreement or can provide an effective, generally applicable explanation as to how they can play so high. Students, therefore, tend to be discouraged when they attempt high-register playing because many experience difficulty even with a note as low as F above middle C; most regard C above high C as unattainable.

To summarize the current status of trumpet players in general then we might say that they fall into one of roughly four categories:

(1) A handful of professional specialists who can, with extreme physical effort and very shallow-cupped mouthpieces, execute the altissimo range up to C above high C, but whose tone is very brassy and shrill.

(2) Perhaps ten percent who can play up to about F above high C, again with extreme effort and shallow-cupped mouthpieces; these players also have a less-than-ideal tone.

(3) Possibly thirty percent who can only play up to about high C, also with extreme effort.

(4) The remaining roughly sixty percent, frequently students, who can only reliably play up to about G below high C, and then with great difficulty. Clearly then, essentially all trumpet players are limited, burdened and/or compromised in some way by mouthpieces that are presently available to them. And, despite attempts by instrument and mouthpiece makers to solve these problems, none to date has been successful; the state-of-the-art of mouthpiece design has progressed essentially no further regarding these particular problems than the two rules-of-thumb stated earlier.

What is needed is a new mouthpiece design that will reduce the difficulty of high-register playing for all brass-instrument players, students as well as professionals, i.e. a design is needed that will make brass-wind instruments, especially the trumpet, physically easier instruments to play. Also, this new design should extend all players' upper registers by a significant number of semitones, ideally five or more. At the same time, this new design should impose no restrictions on tone quality. Accordingly, such a mouthpiece would clearly represent a major improvement over state-of-the-art mouthpiece designs.

As stated earlier, although the above and following discussions are being presented as pertaining to trumpet playing and trumpet mouthpieces, this imposes no conceptual restrictions on the ideas and invention described. These concepts can be applied to all brass-wind mouthpieces.

OBJECTS AND ADVANTAGES

Accordingly, the first objective of this invention is to provide a mouthpiece that will extend the capability of the performer, so that he will be able to play high notes that he is unable to play using currently available mouthpieces.

A second objective of this invention is to provide a mouthpiece that enables performers to play in the high-register with less effort than is required when using currently available mouthpieces.

A third objective of this invention is to provide a mouthpiece that enables high-register playing without sacrifice of tone quality throughout all registers of the instrument.

In the material that follows, my mouthpiece will be shown to meet all of the above objectives. Accordingly, an advantage of my mouthpiece is to enable here-to-fore-average players to become, by mouthpiece change alone, above average players in that they can now qualify to play more difficult music. Similarly, students as well as professionals will become better players, i.e. all players will perform more capably.

Another advantage is that students will tend no longer to be discouraged by their present high-register problems; this is very important, because students make up the bulk of the brass-playing community.

Still further advantages will become apparent from a consideration of the ensuing description and drawings.

DRAWING FIGURES

FIG. 1 is an axial cross-sectional view of a current, state-of-the-art, brass-wind mouthpiece with salient features identified.

FIG. 2A is an axial cross-sectional view of my mouthpiece viewed horizontally when the mouthpiece is in a horizontal playing position.

FIG. 2B is a perspective view of my mouthpiece showing the contours of the inside surfaces of upper and lower complimentary-fractional cups.

FIG. 2C is an axial cross-sectional view of my mouthpiece showing an alternative embodiment wherein the remainder of the lower complimentary-fractional cup surface has been hollowed out behind the leading convex portion of this surface.

REFERENCE NUMERALS IN DRAWINGS (A) Pertaining to conventional mouthpiece of FIG. 1

4 radially symmetric cup
6 throat opening
8 backbore
10 shank
12 cosmetic surface
14 annular rim surface (B) Pertaining to my mouthpiece of FIGS. 2A, 2B,and 2C

18 concave upper-half-cup
20 compound lower-half-cup
22 shank
24 backbore
26 concave upper-half-cup surface
28 leading convex portion also called the lip restrictor, of the compound lower-half-cup surface
30 remainder of the compound lower-half-cup surface
32 throat opening
34 rim surface
36 alternative concave remainder of the compound lower-half-cup surface
38 cavity behind lip restrictor in alternative embodiment
40 cosmetic surface
42 smoothly merging intersection of the concave upper-half-cup surface, the leading convex portion and the remainder of the compound lower-half-cup surface.

SUMMARY OF INVENTION

This invention is a brass-wind musical instrument mouthpiece having, incorporated into the cup surface, rim, or both, a means for exploiting a user's bottom lip intrusion into the mouthpiece. By variably constraining the user's bottom lip, higher attainable between-lip contact pressures are achieved which results in significant increase in high-range. Also, the instrument becomes generally easier to play in the high-register, and the tone quality of conventional mouthpieces is retained.

Description—FIGS. 2A to 2C

Turning again to the drawings, FIG. 2A shows a cross-sectional view of my mouthpiece. This view is formed by passing a vertical plane through the axis of the mouthpiece while the mouthpiece is assumed to be in a horizontal playing position. The salient features are a concave upper-half-cup 18, a compound lower-half-cup 20, a concave upper-half-cup surface 26, a leading convex portion of the compound lower-half-cup surface hereafter called the lip restrictor 28, a remainder of the compound lower-half-cup surface 30, a rim surface 34, a throat opening 32, a backbore 24, a shank 22, and a cosmetic surface 40.

The concave upper-half-cup 18 is an essentially concave surfaced cavity substantially located above the horizontal midplane. The concave upper-half-cup surface 26 is smoothly joined at the throat opening 32 to the backbore 24 which forms an air passageway through the shank 22. The outer surface of the shank 22 is smoothly joined to the cosmetic surface 40. The cosmetic surface 40 is joined to the rim surface 34. The rim surface 34 is then smoothly joined to the concave upper-half-cup surface 26. The rim surface 34 also smoothly adjoins the lip restrictor 28. The lip restrictor 28 is then smoothly joined to the remainder of the compound lower-half-cup surface 30 which merges smoothly at the throat opening 32 with the backbore 24 and with the concave upper-half-cup surface 26 near the horizontal midplane.

FIG. 2B is a perspective view showing the mouthpiece cup contours. Seen here are the rim surface 34 adjoining the concave upper-half-cup surface 26 and the lip restrictor 28. Also shown in this view is the smoothly merging intersection 42 of the concave upper-half-cup surface 26 with the remainder of the compound lower-half-cup surface 30, and with the edges of the lip restrictor 28.

The surface contour of the remainder of the compound lower-half-cup surface 30 can be substantially convex as shown in FIGS. 2A and 2B. An alternative embodiment is possible wherein this remainder of the compound lower-half-cup surface can be concave, as shown in FIG. 2C, and designated as alternate concave remainder of the compound lower-half-cup surface 36. In this embodiment, a cavity of arbitrary size 38 is inserted behind the lip restrictor 28 for the purpose of enlarging overall cup volume. This embodiment tends not to perform as well as the preferred embodiment of FIG. 2A, but is shown, because it too is nevertheless also superior to currently available radially symmetric mouthpieces.

Although different players' lips will possibly respond with slightly differing efficiencies depending on the radii of curvature of the lip restrictor 28, and the concave upper surface 26, prototypes suggest that the lip restrictor 28 should be of a convexity sufficient to limit the lower lip to a maximum forward intrusion into the cup of about 2.4 millimeters measured from the rim surface 34 into the compound lower-half-cup 20. If the convexity is more restrictive than this, it could inhibit or even prevent lower lip vibration altogether; this would make the extreme lower register slightly more difficult to play, because the lowest few notes on the trumpet for example from low B flat to low F sharp, do require a significant amount of lower lip vibration if good tone is to be expected in this range. The required radius of convexity to accomplish this lip restriction was found to be about 3.2 millimeters.

The concave upper-half-cup surface 26 can be sized to produce a desired tone, i.e. more concavity gives a larger cup volume and a "darker" more mellow sound. The preferred concavity would be achieved by a cup depth of about a centimeter measured from the rim surface 34 axially into the mouthpiece, and a cup diameter of about 16 millimeters. Because tone is also determined to some extent by the shape and size of the backbore 24, some variability in the selection of cup depth can be tolerated without departing from the spirit of the asymmetric cup concept. Tone is a matter of aesthetics. The preferred embodiment specified here coupled with a nominally sized backbore will yield a mouthpiece with only a slight "edge" on the tone when played at mezzoforte acoustical volume.

While my mouthpiece has been illustrated in the preferred embodiment, other embodiments are clearly conceivable. One such is shown in FIG. 2C, in which a cavity 38 forming a concave surface 36 is located behind the lip restrictor for the purpose of enlarging the overall cup volume. Another embodiment might be fabricated by altering the concave upper-half-cup surface 26 in some way such as by introducing convexity here or by over enlarging the concave upper-half cup 18. Still another could be realized by incorporating the lip restrictor 28 into the rim surface 34 with no alteration to the conventional symmetric cup. Prototypes have indicated, however, that embellishments such as these, while possibly out performing conventional mouthpieces, are inferior to the preferred embodiment. And although such embodiments may be structurally unique, they do not constitute a departure from the spirit of my invention.

Operation of Invention

My asymmetric mouthpiece is used in exactly the same manner as a symmetric mouthpiece is used with one small but important exception. The asymmetric mouthpiece must be inserted into the brass instrument with the convex portion of the cup surface down, so as to be substantially nearer the bottom lip than the top lip of the performer. Once installed with this orientation, no other special consideration is required because the mouthpiece does not rotate in the instrument when playing. Tests showed that as much as ten degrees of rotation, clockwise or counterclockwise could be tolerated without significantly impairing the mouthpiece's efficacy. Also the orientation of the brass instrument slides, valves or other structure visa vis the mouthpiece's axial orientation provides the player with an instant visual confirmation of the mouthpiece's axial orientation when playing. This orientation will remain substantially constant, because the performer's hand positions when playing the instrument must remain substantially constant to assure unimpaired instrument valve or slide manipulation. These considerations will not be affected by the choice of any particular embodiment of my mouthpiece.

Embodiments other than the preferred embodiment would also be used as described above, would tend to operate in the same manner as described and would be governed by the same theory of operation which follows.

Theory of Operation

To facilitate understanding of how my mouthpiece meets the stated objectives, a few required introductory remarks about the mechanism of sound production using a brass-wind instrument mouthpiece are now given.

A popular misconception about brass instrument sound production is that because sound is produced by a performer's tensed, vibrating lips, then pitch can be raised by increasing tension in this lip tissue. We can see, however, using elementary physical analysis, that increased tension alone, in the performer's lip tissue is insufficient to provide the lip vibration frequency required to execute the complete range of frequencies expected from a brass-wind instrument. The French horn, for example produces about four usable octaves. Raising a pitch by one octave doubles its frequency.

Four octaves raises it sixteen fold. If we assume that all physical parameters such as lip elasticity, mass etc. are constants, and tension and frequency alone are allowed to vary, we can, using the elementary equation for frequency vs tension in a simple vibrator, express the ratio of highest to lowest tension as $$\frac{\sqrt{\text{highest tension}}}{\sqrt{\text{lowest tension}}} = \frac{\text{highest frequency}}{\text{lowest frequency}} = 16$$

so that even if the lowest tension were only a few ounces, the highest tension would be over thirty pounds and would rupture soft lip tissue. Thus, we can conclude that lip tissue tension alone cannot produce a four octave range. What then, we might ask, is the supplementary mechanism?

The facts are that although higher frequencies do depend to some extent on increased lip tissue tension, the major causal mechanism at work here is a reduction in the mass of the vibrating upper lip. This reduction is caused by the lower lip in the following way. When the performer wishes to raise the pitch he compresses his bottom lip upward against his top lip. This upward compression has the effect of partially immobilizing the upper lip and thus reducing its effective vibrating mass. When the mass of a vibrator is reduced, the frequency of vibration increases, and the pitch becomes higher.

This effect is seen with other vibrators such as a violin string, for example. To raise the pitch, a violinist shortens the string by pressing it down against the violin neck with his finger. The only portion that is then vibrating lies between his finger and the bridge; this part contains less mass than the complete string with no finger down to shorten it. Thus, the lighter, shorter string has a higher pitch. The tension in the string is essentially the same, with and without the shortening. A brass player's two lips function together much like the violin string and the violinist's finger.

Experimental studies have verified that the upper and lower lips of a trumpet player function in these two distinct and different ways. In these studies, the upper lip function was shown to be to vibrate back and forth so as to admit consecutive puffs of air into the mouthpiece thus creating the alternating air compressions and rarefactions required for sound production. The principal function of the lower lip was shown to be to press upward against the upper lip so as to control the frequency of vibration of the upper lip by reducing, to varying degrees, its effective vibrating mass.

Having discussed this concept of embouchure mechanics, I would now like to review brass-wind instrument mouthpiece geometry as it relates to the theory that I developed from systematic experimental studies along with developmental prototypes, to arrive at and support my mouthpiece concept.

If we examine currently available, state-of-the-art brasswind mouthpieces we find that, without exception, they are radially symmetric. This suggests that manufacturers may currently believe that although the top and bottom lips are apparently of differing physical structure, and although they perform strikingly different functions, a mouthpiece can function well without taking this into account, i.e. all commercially available, radially symmetric mouthpieces do not acknowledge either physical or functional differences between upper and lower lips. We note, in contrast, that this is decidedly not the case with reed instruments such as the clarinet or saxophone. With these instruments, the mouthpieces are highly asymmetric and are designed specifically to accommodate both physical and functional upper and lower lip differences. A likely explanation for brass mouthpiece symmetry is that manufacturers may not understand or place any importance on the embouchure mechanics discussed above.

Another explanation might be that mouthpieces have always been made this way. Historically, the first "horns" were, in all likelihood, animal horns with the small tip cut off, hence the nomenclature "horn" for a brass musical instrument; since then, the natural symmetry of the animal horn has prevailed. Also mouthpieces are made on lathes,and this mode of manufacture may have tended to perpetuate the notion of symmetry as being required or even ideal. At any rate, radial symmetry has never been questioned, with specific regard to the differing lip functions explained above, until now.

Conjecturing that a mouthpiece cup could possibly respond differently to top and bottom lips as well as to cup depth, experiments were performed using a statistical regression model in which the top half of the cup, the bottom half of the cup, and the cup depth were treated as independent variables. Optimization of the resulting statistical response equation showed the ideal mouthpiece to have a concave upper half and a convex lower half. These experiments along with several subsequent prototypes made to explore and develop this configuration, led to developing the following theoretical explanation for the experimental results and ultimately to my invention itself.

Let us assume that at some arbitrary frequency, a player's bottom lip is exerting an upward force sufficient to ensure that the effectively correct mass of upper lip tissue will be vibrating to produce this frequency. As the player attempts higher and higher frequencies, eventually he attains the maximum amount of upward push that he is capable of exerting and at that point is playing the highest pitch that he is capable of producing. We now consider the bottom lip in more detail.

The portion of the bottom lip tissue that lies inside the boundary of the mouthpiece rim surface is constrained on one side by the player's lower teeth. This portion is also further substantially constrained on its lateral and bottom sides, when viewed with the mouthpiece axis in a horizontal playing position, by the mouthpiece rim surface. It is not, however, constrained on its front surface, which faces into the mouthpiece cup, nor is it constrained on its top surface, which surface is being pushed upward by the player against his top lip. This upwards push is caused by the combined actions of pressing the mouthpiece against the lips and contracting the lip muscles, especially those muscles which control the lower lip. The lip tissue then bulges upward and forward, the only directions in which it is not confined. The upward component of the bulge is producing the required upper lip immobilization and the forward component of the bulge causes lower lip tissue to enter the mouthpiece. This forward bulge contributes no constructive or significant action except to reduce the cup volume slightly which produces a slight to negligible effect on intonation and tone quality. With this in mind, we now consider an alternative geometry for the bottom half of the cup.

If the leading lower cup surface edge nearest to the bottom lip were made sufficiently convex, the portion of the lower lip tissue that would normally intrude into the cup would now tend to be pushed backward toward the player (to varying degrees depending on mouthpiece pressure against the lips) when it encountered this convexity. The lower lip tissue then, being an elastic container filled with an essentially incompressible fluid, blood, would act much like a balloon filled with water and would accommodate this additional compression by bulging even further in the only remaining unconstrained direction, namely upward against the upper lip. This additional upward push would then result in higher between-lip contact pressure causing additional upper lip immobilization and therefore in an increase in upper lip vibration frequency i.e. higher pitch. Prototypes have shown a typical increase in attainable range due to this mechanism of five to seven semitones. Thus, by making the leading edge of the bottom surface of the cup sufficiently convex, the first objective of the invention, significant increase in high range, is realized.

Furthermore, because of the generally convex shape of this leading edge, the action of this mechanism is a progressive and continuously increasing one with pitch, i.e. it has little to no effect in the middle and low registers where lip intrusion is negligibly small, and a gradually increasing effect with frequency into the higher range where air pressure is higher and the associated increased mouthpiece pressure against the lips and increased muscular contraction normally causes larger lower lip intrusions. Thus, the leading convex lower surface, i.e. the "lip restrictor", not only extends a player's high-range capability but makes all high-range playing easier. Accordingly, the second objective of the invention is realized.

The leading edge convexity of the lower cup surface by itself would reduce overall cup volume. Without compensating for this reduction, tone would tend toward the brassiness of shallow conventional-cup mouthpieces. This cup volume reduction can be compensated for, however, by enlarging the upper concave portion of the cup. Thus, if we know that a particular symmetric cup volume will produce a particularly desirable tone quality, then instead of reducing that volume by making the cup shallower in order to obtain high-range capability, as is currently done, and thereby destroying the tone, we spatially redistribute the particular cup volume by making the bottom surface convex and the top surface sufficiently concave. Studies have shown that total cup and backbore volume rather than the particular shape of a cup, tend to determine tone quality for a given player. Thus, the asymmetric cup would have essentially the same total cup volume as the symmetric cup, and the tone quality would remain unimpaired. But higher notes and an overall ease of playing would be gained over the symmetric cup mouthpiece. Accordingly, the third objective is realized.

It should be noted that any symmetric embodiment of the lip restrictor would also restrict the upper lip and inhibit vibration of this lip. Even if such a restrictor were relatively small in width, it would also reduce the span of the cup for the upper lip. But the full span of the mouthpiece is required for the upper lip lest the vibrating mass be over restricted, i.e. bottom lip performance is enhanced by the restrictor, but to simultaneously restrict the top lip would impair its performance. Thus, asynunetry is required.

While I believe that this theory explains the experimental results, both from the regression analysis and the prototypes, I don't want to be totally bound by this. As with any theory, some subtlety may have eluded me. This theory has, however, enabled me to conceive the invention described which performs as outlined herein.

Summary, Ramifications, and Scope

In summary, the asyntmetric-cup design adds as much as one half octave of high range capability, makes all notes in the high range generally easier to produce and does this with no loss of tone quality as is seen in conventional symmetric mouthpieces wherein reduced cup volume alters tone. The asymmetric-cup mouthpiece discussed herein is therefore undeniably and significantly superior to radially symmetric mouthpieces. Furthermore, the theory underlying this invention is substantiated by prototypes and systematically obtained experimental data and does not exclusively rely on cut-and-try efforts.

Although the discussion presented herein implies that the asymmetric cup is composed of top and bottom halves, this in no way is meant to suggest that the concept is restricted to a cup that is divided exactly into top and bottom halves. A few prototypes were divided into different complimentary fractional cups such as two thirds top and one third bottom, and similar results were obtained.

Similarly, the "bottom-lip-controlling" action of the bottom convex cup surface was produced, with only partial success, by other similiar means of bottom lip restriction that enabled exploitation, in a similar manner, of the bottom lip intrusion forward into the cup; similar but less desirable results were obtained. An example of such a restriction would be a widening of the lower part of the rim surface while leaving the cup substantially symmetric as in conventional mouthpieces.

Accordingly, my mouthpiece should not be construed as having specifically upper and lower halves with concave and convex surfaces respectively. Instead, it is a mouthpiece in which the cup or rim or both are shaped so as to enable exploitation of the lower lip forward bulge into the mouthpiece. Partially because of the smooth transition surfaces having no abrupt irregularities along the axial direction of airflow, the preferred embodiment tends to exhibit superior performance.

Thus, although the scope of my invention will be determined by the appended claims and their legal equivalents, these can possibly be more effectively interpreted in the light of the examples given.

I claim:

1. A mouthpiece for brass-wind musical instruments, said mouthpiece comprising:

(A) an enlarged head portion forming and comprising a cavity, hereinafter called a cup, said cup comprising upper and lower interior cup surfaces, and an annular rim surface that smoothly, circumferentially and continuously abuts said upper and lower interior cup surfaces, said upper interior cup surface being an essentially conventional, concave, and inwardly tapered surface of revolution, (B) a convex, radially asymmetric lower-lip restrictor comprising a radially asymmetric bulge in said lower interior cup surface, said radially asymmetric bulge being relatively wide circumferentially of the cup, disposed essentially toward the front of the lower half of the cup, occupying up to essentially one half of the cup volume, horizontally spanning the cup, smoothly merging with said annular rim surface and configured so as to preferentially contact and compress a user's lower lip only, and (C) an elongated, tapered, substantially tubular shank adjacent to and connected to said enlarged head portion and adapted to be connected to one of said brass-wind musical instruments, said elongated, tapered, substantially tubular shank containing an air passageway extending into said cup for passing air and lip vibrations of a user's lips into one of said brass-wind musical instruments.

2. A mouthpiece in accordance with claim 1 wherein, said cup comprises upper and lower juxtaposed, complimentary fractional cups, said upper and lower, juxtaposed, complimentary fractional cups being formed by passing a horizontal geometric plane through said cup parallel to an axis of said mouthpiece, said axis extending through said cup and said elongated, tapered, substantially tubular shank, the upper of said juxtaposed, complimentary fractional cups having a substantially concave surface, and the lower of said juxtaposed, complimentary fractional cups having a substantially convex surface, said convex, radially asymmetric lower-lip restrictor comprising a leading edge of said juxtaposed, complimentary fractional cup having said substantially convex surface, said leading edge smoothly abuting said annular rim surface.

3. A mouthpiece in accordance with claim 1 wherein, said cup comprises upper and lower, juxtaposed, complimentary fractional cups, said upper and lower, juxtaposed, complimentary fractional cups being formed by passing a horizontal geometric plane through said cup parallel to an axis of said mouthpiece, said axis extending through said cup and said elongated, tapered, substantially tubular shank, the upper of said juxtaposed, complimentary fractional cups having a substantially concave surface, and the lower of said juxtaposed, complimentary fractional cups having a compound surface, said compound surface comprising a leading convex portion which smoothly abuts said annular rim surface, and a substantially concave remainder which smoothly joins said leading convex portion with said air passageway, said convex, radially asymmetric lower-lip restrictor comprising said leading convex portion of said compound surface.

* * * * *